US011117719B2

(12) United States Patent
McConnell

(10) Patent No.: US 11,117,719 B2
(45) Date of Patent: Sep. 14, 2021

(54) SELECTIVE FLOW COHESIVE STREAMING CAPS

(71) Applicant: Troy McConnell, Houston, TX (US)

(72) Inventor: Troy McConnell, Houston, TX (US)

( * ) Notice: Subject to any disclaimer, the term of this patent is extended or adjusted under 35 U.S.C. 154(b) by 0 days.

(21) Appl. No.: 17/144,547

(22) Filed: Jan. 8, 2021

(65) Prior Publication Data

US 2021/0214133 A1 Jul. 15, 2021

Related U.S. Application Data

(60) Provisional application No. 62/959,157, filed on Jan. 9, 2020.

(51) Int. Cl.
*B65D 47/26* (2006.01)
*B67B 3/20* (2006.01)
*B65D 47/04* (2006.01)

(52) U.S. Cl.
CPC ..... *B65D 47/265* (2013.01); *B65D 47/043* (2013.01); *B67B 3/20* (2013.01)

(58) Field of Classification Search
CPC .... B65D 47/043; B65D 47/40; B65D 47/061; B65D 47/242; B65D 47/263; B65D 47/265; B65D 47/266; B67B 3/20
See application file for complete search history.

(56) References Cited

U.S. PATENT DOCUMENTS 646,846 A * 4/1900 Lepore ..... A47G 19/24 222/142.9
2,241,044 A * 5/1941 Birger Stenberg Knut E ..... B65D 47/265 222/142.9
2,961,132 A * 11/1960 Ankney ..... B65D 47/36 222/480
3,439,841 A * 4/1969 Rhodes ..... B65D 81/3227 222/142.5
4,196,857 A * 4/1980 Bauer ..... B05B 1/08 239/327
4,308,979 A 1/1982 Otterson
(Continued)

FOREIGN PATENT DOCUMENTS

EP 1433716 A1 6/2004
ES 2343856 T3 11/2010
(Continued)

OTHER PUBLICATIONS

Crescent_Definition_of_Crescent_by_Merriam-Webster, Mar. 13, 2021, https://www.merriam-webster.com/dictionary/crescent.*
(Continued)

*Primary Examiner* — Frederick C Nicolas
*Assistant Examiner* — Randall A Gruby
(74) *Attorney, Agent, or Firm* — Victor H. Segura

(57) ABSTRACT

A container cap with a body having a lower portion with internal threads for connecting to a container, and an upper portion defining a main opening. The upper cap portion having a first surface defining a partial opening and a stem protruding through the main opening. The lower cap portion having a second surface defining a partial opening. The upper and lower cap portions configured to rotate with respect to one another such that the partial openings align between a closed position and an open position to selectively permit fluid flow therethrough. A method for capping a container.

16 Claims, 4 Drawing Sheets

(56) References Cited

U.S. PATENT DOCUMENTS

| | | | | |
|---|---|---|---|---|
| 4,380,307 | A * | 4/1983 | Stillinger | B65D 47/265 222/142.9 |
| 4,690,304 | A * | 9/1987 | Morel | G01F 11/263 222/44 |
| 4,946,080 | A * | 8/1990 | Vesborg | G01F 11/263 222/500 |
| 5,022,562 | A * | 6/1991 | Lurkis | B65D 47/243 220/260 |
| 5,145,094 | A * | 9/1992 | Perlmutter | B65D 47/247 215/311 |
| 5,320,260 | A * | 6/1994 | Song | B65D 47/40 222/547 |
| 5,692,633 | A | 12/1997 | Gordon | |
| 5,921,440 | A * | 7/1999 | Maines | B65D 47/265 222/145.2 |
| 6,164,495 | A * | 12/2000 | Manesis | A61F 9/0008 222/129 |
| 6,769,573 | B1 * | 8/2004 | Kazarian | B05B 11/3081 222/136 |
| 8,033,419 | B1 | 10/2011 | Szekely | |
| 8,919,592 | B2 * | 12/2014 | Buck | A47G 19/2222 220/253 |
| 9,981,786 | B2 | 5/2018 | Meyer | |
| 10,494,153 | B2 | 12/2019 | Meyer | |
| 10,822,147 | B2 | 11/2020 | Bongiovanni | |
| 2001/0011446 | A1 * | 8/2001 | McClean | B65D 47/0847 53/452 |
| 2006/0108363 | A1 * | 5/2006 | Yates, III | B65D 21/0201 220/23.4 |
| 2006/0278640 | A1 * | 12/2006 | Watts | B65D 47/265 220/212 |
| 2007/0095831 | A1 * | 5/2007 | Thatcher | B65D 47/243 220/212.5 |
| 2009/0084752 | A1 | 4/2009 | Coulson | |
| 2010/0252586 | A1 * | 10/2010 | Jimenez | B65D 83/06 222/480 |
| 2013/0153085 | A1 * | 6/2013 | Shefler | B65D 1/04 141/9 |
| 2015/0272358 | A1 | 10/2015 | Humphreys | |
| 2018/0037382 | A1 * | 2/2018 | Huss | B65D 1/10 |

FOREIGN PATENT DOCUMENTS

| | | | |
|---|---|---|---|
| JP | 2011016581 | A | 1/2011 |
| WO | 2015053865 | A1 | 4/2015 |

OTHER PUBLICATIONS

Half-Moon_Definition_of_Half-Moon_by_Merriam-Webster, Mar. 13, 2021, https://www.merriam-webster.com/dictionary/half-moon.*

Lid_Definition_of_Lid_by_Merriam-Webster, Mar. 13, 2021, https://www.merriam-webster.com/dictionary/lid.*

STEM _ definition in the Cambridge English Dictionary, Mar. 13, 2021, https://dictionary.cambridge.org/us/dictionary/english/stem.*

International Search Report and Written Opinion, International Application No. PCT/US2021/012652 dated Mar. 18, 2021.

* cited by examiner

SELECTIVE FLOW COHESIVE STREAMING CAPS

CROSS-REFERENCE TO RELATED APPLICATIONS

This application claims priority to U.S. Provisional Patent Application No. 62/959,157 filed on Jan. 9, 2020, titled "Selective Flow Cohesive Streaming Caps." The entire disclosure of Application No. 62/959,157 is hereby incorporated herein by reference.

FIELD OF THE INVENTION

The present disclosure relates to caps for containers, and more particularly, to improved caps providing selective fluid flow from containers in a cohesive and controlled stream.

BACKGROUND

Caps are well known for sealing and providing operable closures for fluid containers. Fluid containers are generally formed with a neck or extension terminating with a threaded opening to receive a cap and provide a pouring aperture. Conventional caps are configured with internal threads for complementary engagement with the external threads formed on the container neck or extension. When pouring fluids from containers it is common to use a separate funnel to guide the fluid and avoid spillage (e.g., funnels me typically used to pour oil from bottles into car engine blocks). A need remains for improved caps for fluid containers.

SUMMARY

According to an aspect of the invention, a container cap includes a cap body having a lower portion with internal threads for connecting to a container, and an upper portion defining a main opening. The upper portion has a first surface defining a partial opening and a stem protruding upwardly from the first surface through the main opening. The lower portion has a second surface defining a partial opening. The upper portion and the lower portion rotate with respect to one another such that the partial opening in the first surface and the partial opening in second surface align between a closed position and an open position to selectively permit fluid flow therethrough.

According to another aspect of the invention, a method of capping a container includes connecting a cap to a container, the cap comprising a body having a lower portion with internal threads for connecting to the container, and an upper portion defining a main opening. The upper portion has a first surface defining a partial opening and a stem protruding upwardly from the first surface through the main opening, a lower portion has a second surface defining a partial opening, and the upper portion and the lower portion are configured to rotate with respect to one another such that the partial openings in the first and second surfaces align between a closed position and an open position to selectively permit fluid flow therethrough.

According to an aspect of the invention, a container cap includes a cap body having a lower portion with internal threads for connecting to a container, and an upper portion defining a main opening. The upper portion has a first surface defining a partial opening. The lower portion has a second surface defining a partial opening. The upper portion and the lower portion rotate with respect to one another such that the partial openings in the first and second surfaces align between a closed position and an open position to selectively permit fluid flow therethrough.

BRIEF DESCRIPTION OF THE DRAWINGS

The following figures form part of the present specification and are included to further demonstrate certain aspects of the present disclosure and should not be used to limit or define the claimed subject matter. The claimed subject matter may be better understood by reference to one or more of these drawings in combination with the description of embodiments presented herein. Consequently, a more complete understanding of the present embodiments and further features and advantages thereof may be acquired by referring to the following description taken in conjunction with the accompanying drawings, in which like reference numerals may identify like elements, wherein:

DETAILED DESCRIPTION

The foregoing description of the figures is provided for the convenience of the reader. It should be understood, however, that the embodiments are not limited to the precise arrangements and configurations shown in the figures. Also, the figures are not necessarily drawn to scale, and certain features may be shown exaggerated in scale or in generalized or schematic form, in the interest of clarity and conciseness.

Figure 1:
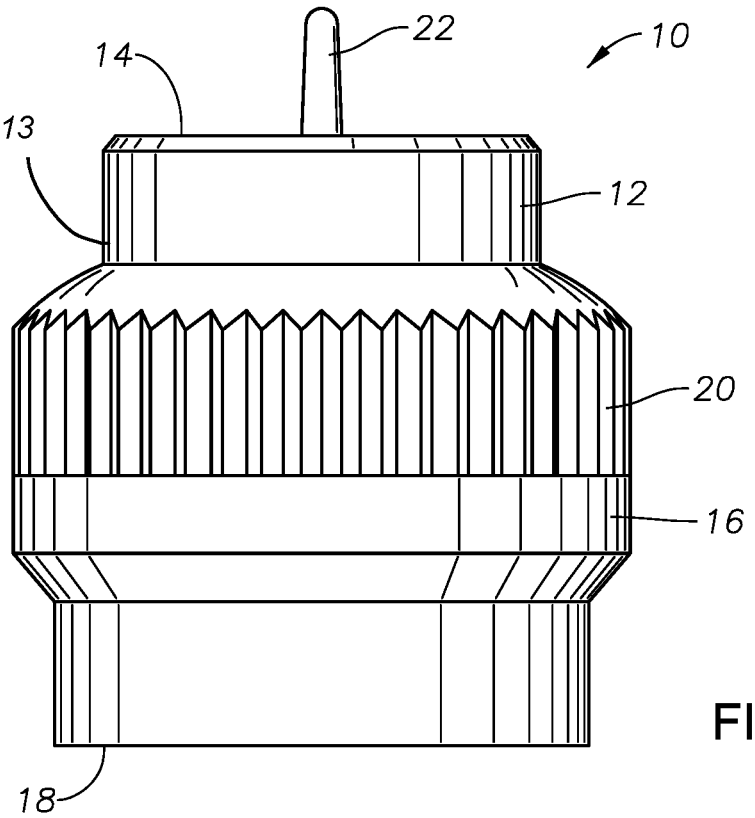
FIG. 1 shows a schematic of a cap according to an example of the present disclosure.

FIG. 1 shows a side view of cap 10 embodiment of this disclosure. The cap 10 is generally cylindrical in shape, with an upper portion 12 with a walled section 13 defining a main opening 14. A lower portion 16 is coupled to the upper portion, as further described below. The lower portion 16 also has an opening 18. As shown in FIG. 1, in some embodiments the central section of the cap body extends outwardly with a greater diameter compared to the diameter of the upper portion 12 forming the main opening 14 and the lower portion 16 forming the lower opening 18. Embodiments may also be implemented with a non-smooth exterior surface 20 formed on the upper portion 12 near the central section of the cap 10 body. Some embodiments may also be implemented with a non-smooth exterior surface 20 formed on both the upper 12 and lower 16 portions near the central section of cap 10 body. The non-smooth surface may comprise, for example, a series of ridges, a knurled surface, a pattern of dimples or bumps, or any other conventional means as known in the art to aid in gripping the surface. It will be appreciated by those skilled in the art that embodiments of the cap 10 may be formed of conventional materials as known in the art (e.g., plastics, synthetic materials, composites, metal, metal-plastic combinations, etc.).

Figure 2:
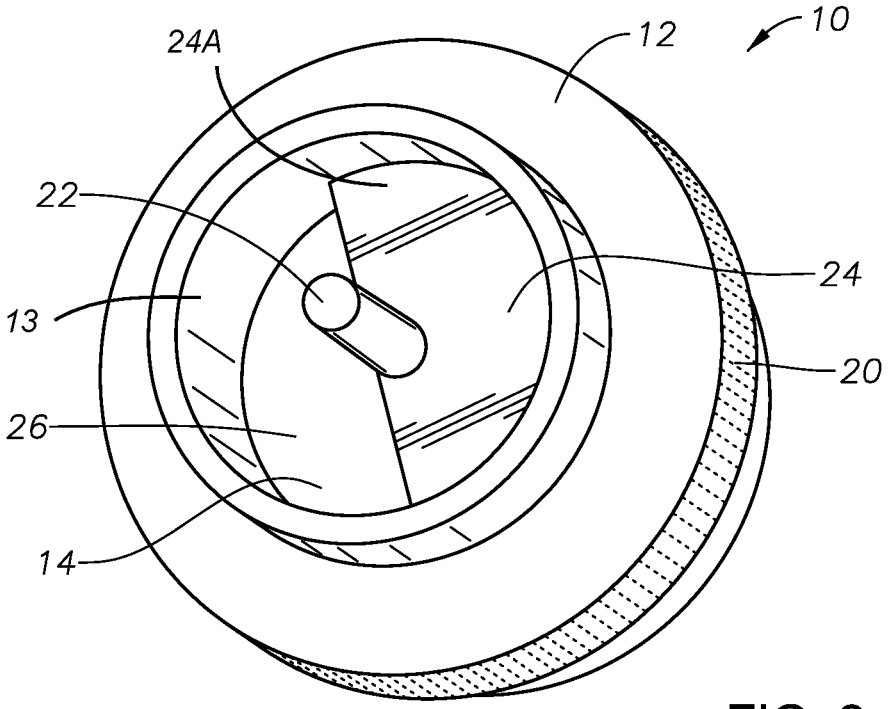
FIG. 2 shows a perspective view of a cap upper portion according to an example of the present disclosure.

FIG. 1 shows a stem 22 protruding upwardly from the main opening 14 of the cap 10. In some embodiments the stem 22 is formed with a taper narrowing toward the tip of the stem. The stem is free from contact with the walled section of the upper portion and unobstructed in a 3608 degree radial direction for the length of the stem. Turning to FIG. 2, a perspective view of the top of the upper portion 12 of the cap 10 is shown. Recessed within the main opening 14, a first surface 24 is formed therein defining a partial opening 26. The first surface 24 is generally planar and extends across the main opening 14 to define the partial opening 26. FIG. 2 shows an embodiment with the partial opening 26 formed as a half moon. Other embodiments may be implemented with the first surface 24 covering more or less of the main opening 14, with other configurations defining the partial opening 26 (e.g., circular hole, slot, etc.). The stem 22 is shown extending upwards from a first side 24A of the first surface 24. The stem 22 may be located proximate the center of the main opening 14 or offset from the center as desired. Embodiments may also be implemented with the stem 22 extending upwards from the first side 24A of the first surface 24 at a right angle to the surface or at an angle with respect to the surface (not shown). The stem 22 enables a funneling action when a fluid is poured through the cap 10, as further described below.

Figure 3A:
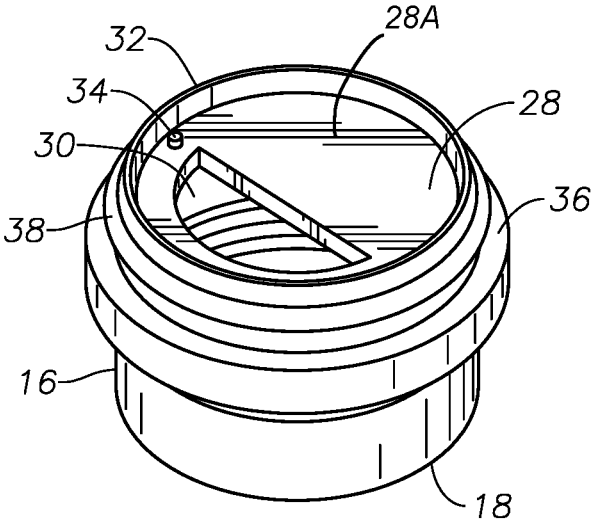
FIG. 3A shows a perspective view of cap lower portion according to an example of the present disclosure.

FIG. 3A shows a perspective view of an embodiment of the lower portion 16 of the cap 10. The lower portion 16 is a unitary piece, separate from the upper portion 12. The two are coupled together as further described below. Slightly recessed from the top section of the lower portion 16, a second surface 28 is formed therein defining a partial opening 30. The second surface 28 is generally planar and extends across the top section of the lower portion 16 to define the partial opening 30. As shown in FIG. 3A, the partial opening 30 is formed as a half moon, corresponding with the half-moon partial opening of the upper portion 12 (See FIG. 2). As previously discussed, other cap 10 embodiments may be implemented with the partial openings 26, 30 in the upper 12 and lower 16 portions having other configurations, preferably with matching configurations.

The top of the lower portion 16 has a 360-degree raised portion 32 formed along the circumference of a first side 28A of the second surface 28. The raised portion 32 is configured for complementary engagement with a depression formed on the lower side of the upper portion 12 (40 in FIG. 3B). A small knob or pin 34 is disposed on the second surface 28, protruding upwards but not past the top edge of the raised portion 32. The pin 34 is disposed near the periphery of the first side 28A of the second surface 28 and configured for complementary engagement with a depression formed on the bottom of the upper portion 12 (42 in FIG. 3B), as described below. The upper section of the lower portion 16 extends outwardly with a greater diameter compared to the diameter of the lower section, forming a shoulder or ledge 36 with a planar surface along the circumference of the lower section. The exterior of the raised portion 32 is configured with a rounded lip 38 formed along the 360-degree perimeter of the lower portion 16. The rounded lip 38 is disposed between the top edge of the raised portion 32 and the shoulder or ledge 36.

Figure 3B:
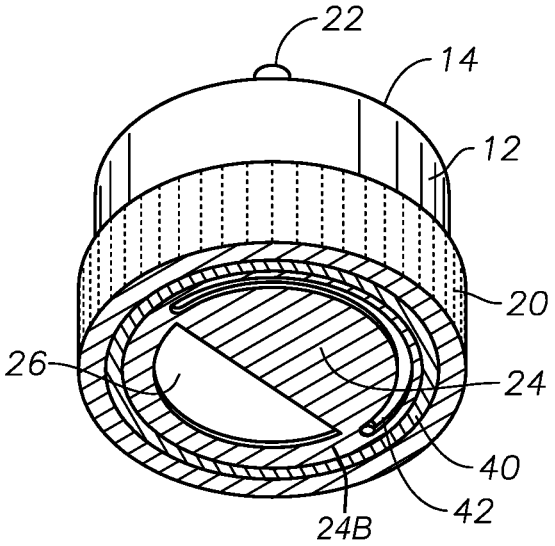
FIG. 3B shows a perspective view of a cap upper portion according to an example of the present disclosure.

FIG. 3B shows a perspective view of an embodiment of the upper portion 12 of the cap 10. The upper portion 12 is a unitary piece, separate from the lower portion 16. FIG. 3B shows the bottom side of the first surface 24. A first depression 40 is formed on the lower a second side 24B of the first surface 24, opposite the first side 24A of the surface 24. The first depression 40 is formed along the 360-degree circumference of the second side 24B of the first surface 24, near the edge of the upper portion 12. The first depression 40 is configured to receive the raised portion 32 formed on the lower portion 16, as further described with respect to FIG. 3C below. A second depression 42 is formed on the second side 24B of the first surface 24. The second depression 42 forms a semi-circle concentric with the first depression 40 and has a shorter radius than the first depression. The second depression 42 is configured to receive the pin 34 on the first side 28A of the second surface 28 of the lower portion 16.

Figure 3C:
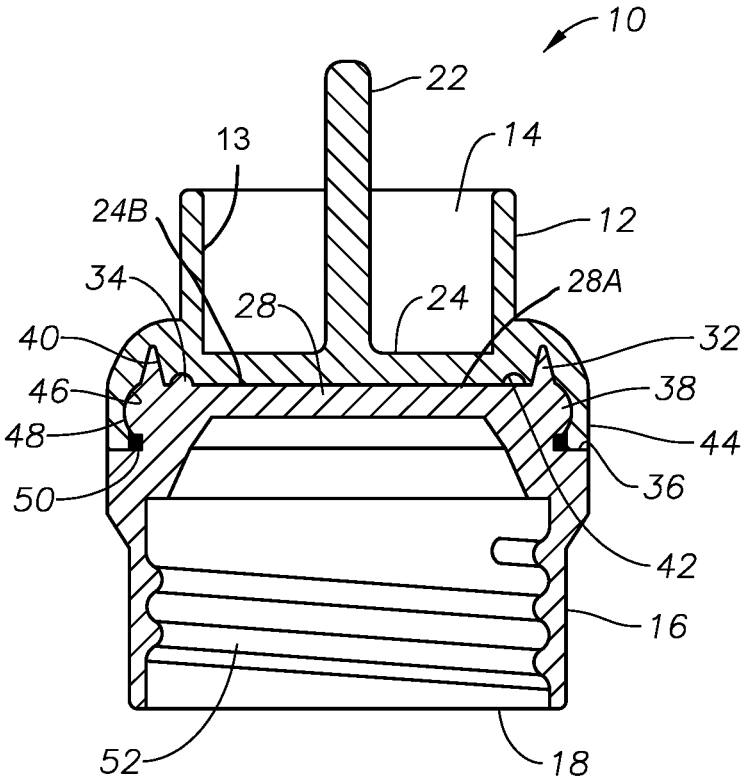
FIG. 3C shows a cross-section of a cap according to an example of the present disclosure.

Turning to FIG. 3C, a cross-section embodiment of the coupled upper 12 and lower 16 portions forming a cap 10 is shown. The junction coupling the two independent portions 12, 16 permits rotation of the pieces with respect to one another. The lower section of the upper portion 12 extends downward forming a 360-degree skirt 44 that terminates in abutment with the shoulder 36 on the second portion 16. The rounded lip 38 on the second portion is snap fit into engagement with an indentation 46 formed along the inner circumference of the skirt 44. The indentation 46 is configured to "cup" the rounded lip 38 such that the lower end of the skirt 44 provides an internal contour 48 to retain the upper portion 12 against the lower portion 16.

Engagement of the two portions 12, 16 via this junction permits rotation of the two pieces with respect to one another while at the same time providing a sealing engagement to restrict fluid passage at the union. In some embodiments, an O-ring 50 may be disposed on the lower portion 16 to provide additional sealing at the junction. FIG. 3C also shows the internal threads 52 formed on the internal diameter of the lower portion 16. Cap 10 embodiments may be configured with internal threads 52 for connection with any connection ports or necks using conventional thread standards. Although FIG. 3C shows a cap 10 embodiment with the stem 22 extending out past the top of the main opening 14, other embodiments may be implemented with the tip of the stem flush with the top edge of the main opening or slightly below the top edge of the opening.

FIG. 3C shows the pin 34 on the first side 28A of the second surface 28 engaged with the second depression 42 on the second side 24B of the first surface 24. This pin-depression engagement provides a detent mechanism to respectively align the partial openings 26, 30 in the first 24 and second 28 surfaces between a fully open or fully closed position when the upper 12 and lower 16 portions are rotated with respect to one another. As shown in FIG. 3B, the second depression 42 is formed in a 180-degree arc on the second side 24B of the first surface 24 on the opposite side of the partial opening 26. The pin 34 on the other portion 16 is positioned near a border of the other partial opening 30 such that when the two portions 12, 16 are coupled together (as shown in FIG. 3C), either portion can be rotated in either direction with respect to the other until the pin hits an end of the depression 42. In this manner, the upper 12 or lower 16 portion can be rotated such that the partial openings 26, 30 align between a closed position and an open position.

Figure 4:
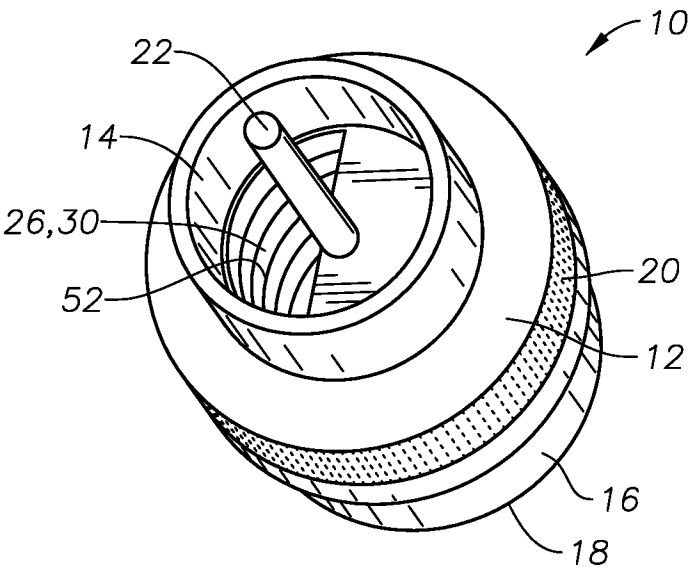
FIG. 4 shows a perspective view of a cap according to an example of the present disclosure.
Figure 5:
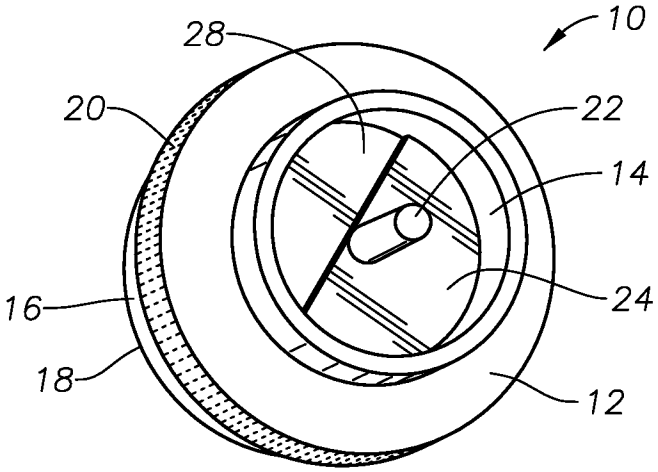
FIG. 5 shows a perspective view of another cap according to an example of the present disclosure.

FIG. 4 shows the cap 10 with the partial openings 26, 30 aligned in the fully open position. FIG. 5 shows the cap 10 with the partial openings 26, 30 aligned in the fully closed position. It will be appreciated by those skilled in the art that cap 10 embodiments of this disclosure may be implemented with the upper 12 and lower 16 portions having reciprocal features. That is, embodiments may be implemented with the detent mechanism comprising a protruding pin 34 formed on the bottom side of the first surface 24 for complementary engagement with a depression 42 formed on the top side of the second surface 28. Other embodiments may be implemented with the raised portion 32 formed along the circumference on the bottom side of the first surface 24 for complementary engagement with a depression formed on the top side of the second surface 28.

Figure 6:
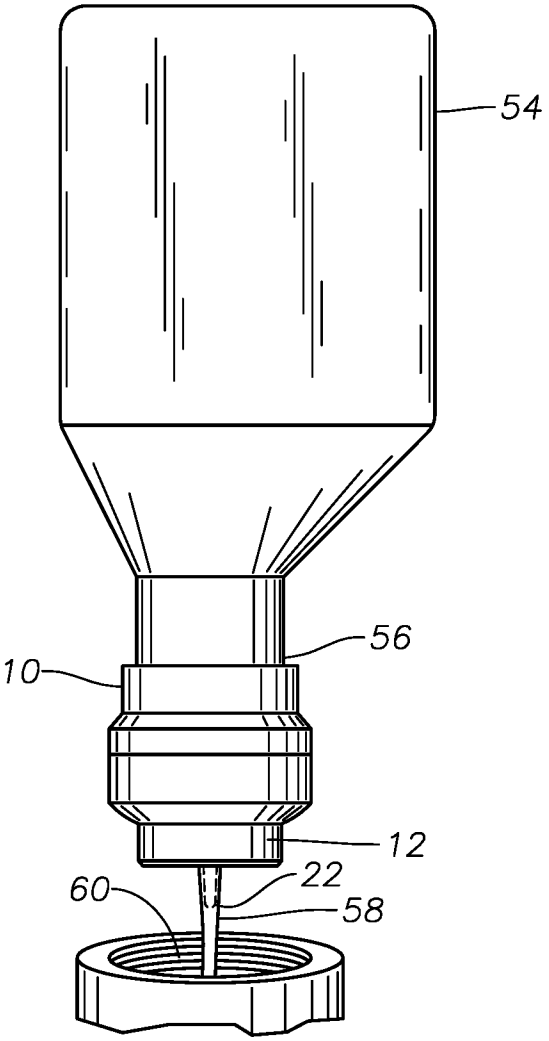
FIG. 6 shows a schematic of a fluid container with a cap according to examples of the present disclosure.

FIG. 6 shows a conventional container 54 (e.g. an oil container) equipped with a cap 10 of this disclosure connected via a threaded neck 56. With the cap 10 securely connected to the neck 56 of the container 54, rotation of the upper portion 12 in either direction varies the alignment of the partial openings 26, 30 (as described herein) to selectively permit fluid flow from the container through the main opening 14 of the cap. As fluid flows from the container 54 past the through port in the cap 10 created by the aligned partial openings 26, 30, the fluid naturally flows along the stem 22 resulting in a funneled or oriented and cohesive stream 58, allowing one to easily pour fluids into hard to reach or narrow reception ports 60 without spillage or use of external funnel means.

Figure 7:
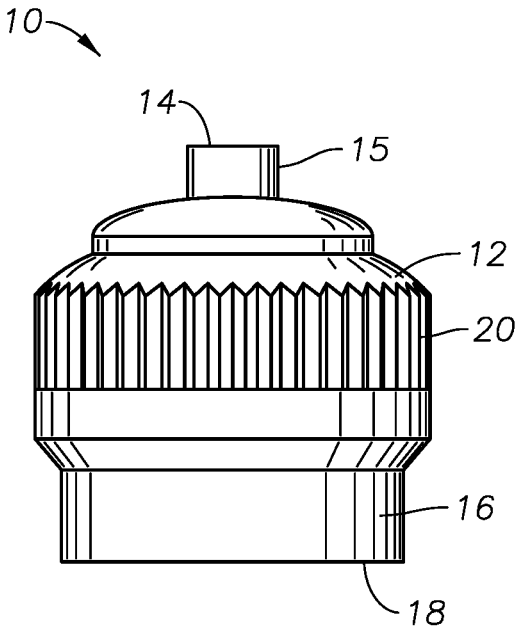
FIG. 7 shows a schematic of a cap according to an example of the present disclosure.

FIG. 7 shows a side view of another cap 10 embodiment of this disclosure. The cap 10 is similar to other embodiments disclosed herein, with an exception that the upper portion 12 is configured with the main opening 14 defining a narrow spout 15 compared to other embodiments. The upper 12 and lower portions 16 are respectively configured with partial openings 26, 30 and a detent mechanism as described herein. Some embodiments may also be implemented with the upper portion 12 incorporating a stem 22 protruding upwardly through the main opening 14 of the cap 10 as described herein.

Figure 8:
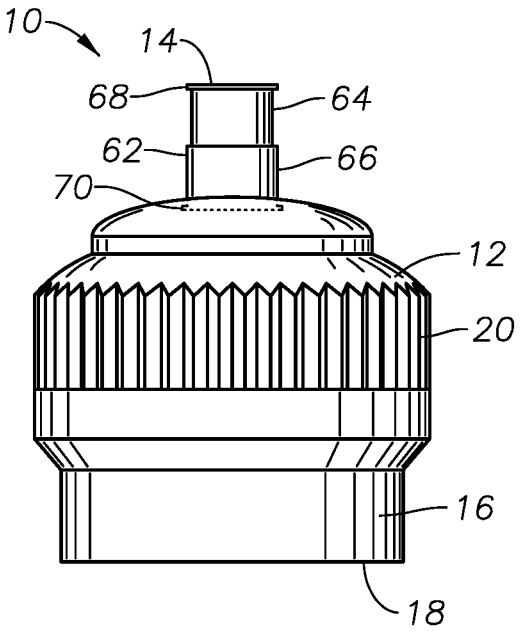
FIG. 8 shows a schematic of another cap according to an example of the present disclosure.

FIG. 8 shows a side view of another cap 10 embodiment of this disclosure. The cap 10 is similar to other embodiments disclosed herein, with an exception that the upper portion 12 is configured with the main opening 14 defining a telescoping spout 62. The telescoping spout 62 is implemented with a cylindrical inner segment 64 configured to reside in a slidable engagement within a spout 66 forming the main opening 14 in the upper portion 12. The upper edge of the inner segment 64 includes a lip 68 formed along the circumference of the opening 14 to provide a stop when the inner segment is residing within the spout 66. The lower end of the inner segment 64 also includes a lip 70 formed along the circumference of the opening to provide a stop preventing the inner segment from detaching when the inner segment is telescopically extended from the spout 66. The upper 12 and lower portions 16 are respectively configured with partial openings 26, 30 and a detent mechanism as described herein. Some embodiments may also be implemented with the upper portion 12 incorporating a stem 22 protruding upwardly through the telescoping spout of the cap 10 as described herein.

Figure 9:
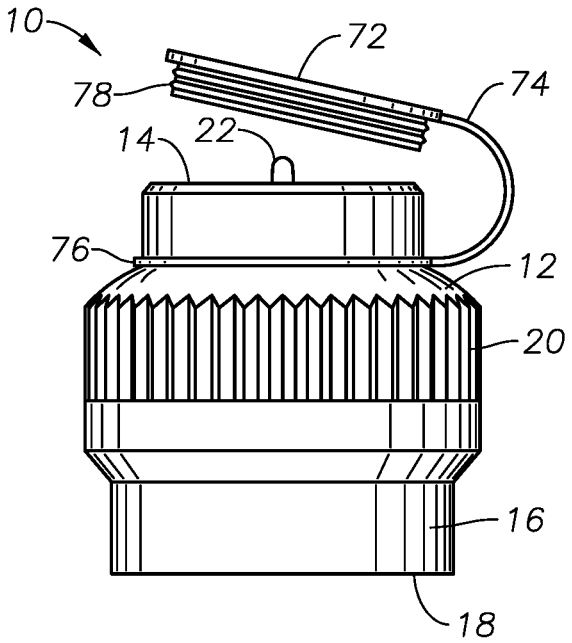
FIG. 9 shows a schematic of another cap according to an example of the present disclosure.

FIG. 9 shows a side view of another cap 10 embodiment of this disclosure. The cap 10 is similar to other embodiments disclosed herein and includes a lid 72 tethered to the upper portion 12. The cap is tethered via a flexible strap 74 held in place by a loop 76 disposed around the upper portion 12 as known in the art. The lid 72 is configured for insertion within the main opening 14 in a plug-type fit. Some embodiments may be implemented with one or more protrusions or ridges 78 formed around the outer circumference of lid 72 to provide a fluid tight seal when the lid is inserted within the main opening 14. The lid 72 also protects the stem 22 and provides a sealing means for transport and storage of the fluid container to which the cap 10 is attached. The upper 12 and lower portions 16 are respectively configured with partial openings 26, 30 and a detent mechanism as described herein.

Figure 10:
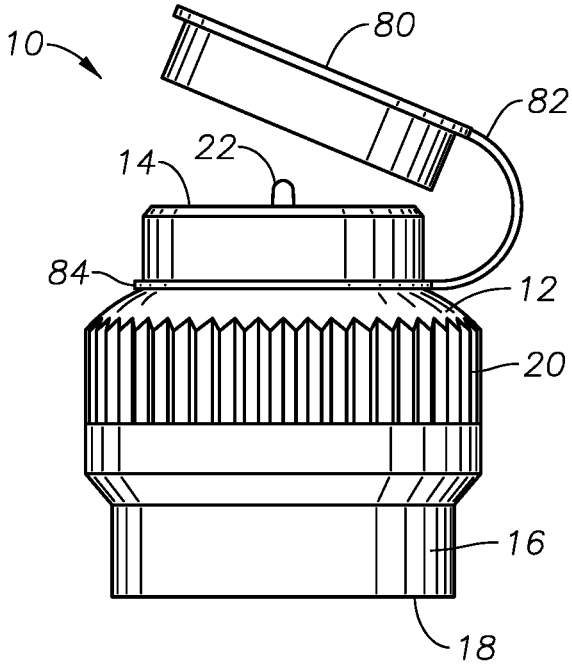
FIG. 10 shows a schematic of another cap according to an example of the present disclosure.

FIG. 10 shows a side view of another cap 10 embodiment of this disclosure. The cap 10 is similar to other embodiments disclosed herein and includes a lid 80 tethered to the upper portion 12. The cap is tethered via a flexible strap 82 held in place by a loop 84 disposed around the upper portion 12 as known in the art. The lid 80 is configured for insertion over the exterior of the main opening 14. The lid 80 protects the stem 22 and provides a sealing means for transport and storage of the fluid container to which the cap 10 is attached. The upper 12 and lower portions 16 are respectively configured with partial openings 26, 30 and a detent mechanism as described herein.

In light of the principles and example embodiments described and depicted herein, it will be recognized that the example embodiments can be modified in arrangement and detail without departing from such principles. Also, the foregoing discussion has focused on particular embodiments, but other configurations are also contemplated. For example, cap 10 embodiments of this disclosure may be implemented to include conventional sealing means to secure the caps on containers and/or prevent inadvertent opening as known in the art (e.g., tear/pull off seals, etc.). It will also be appreciated that the caps 10 of this disclosure can be used with any conventional containers of various types and sizes. Even though expressions such as "in one embodiment," "in another embodiment," or the like are used herein, these phrases are meant to generally reference embodiment possibilities, and are not intended to limit the invention to particular embodiment configurations. As a rule, any embodiment referenced herein is freely combinable with any one or more of the other embodiments referenced herein, and any number of features of different embodiments are combinable with one another, unless indicated otherwise. It will be appreciated by those skilled in the art that cap 10 embodiments may be implemented using conventional materials and manufactured or produced via known processes (e.g., molding techniques, 3D printing, casting techniques, etc.) to operate as disclosed herein.

In view of the wide variety of useful permutations that may be readily derived from the example embodiments described herein, this detailed description is intended to be illustrative only, and should not be taken as limiting the scope of the invention. What is claimed as the invention, therefore, are all implementations that come within the scope of the following claims, and all equivalents to such implementations.

What is claimed is:

1. A container cap comprising:

a cap body having a lower portion with internal threads for connecting to a container, and an upper portion with a wailed section defining a main opening;

the upper portion having a first surface defining an opening and a stem protruding upwardly from a first side of the first surface through the main opening, wherein the stem is free from contact with the walled section of the upper portion and unobstructed in a 360 degree radial direction for the length of the stem;

the lower portion having a second surface defining an opening;

wherein the upper portion and the lower portion rotate with respect to one another such that the opening in the first surface and the opening in the second surface align between a closed position and an open position to selectively permit fluid flow therethrough;

wherein the upper portion and the lower portion comprise separate pieces coupled together via a junction configured to permit rotation of the pieces with respect to one another;

wherein the second surface comprises a raised portion formed along a circumference of a first side of the second surface, the raised portion configured for complementary engagement with a depression formed on a second side of the first surface opposite the first side of the first surface.

2. The container cap of claim 1 further comprising a detent mechanism to align the opening in the first surface and the opening in the second surface in a fully open or fully closed position when the upper portion or the lower portion is rotated with respect to the other portion.

3. The container cap of claim 2 wherein the detent mechanism comprises a protruding pin formed on one of the first or second surface, the pin configured for complementary engagement with a depression formed on the other of the first or second surface.

4. The container cap of claim 1 wherein the opening on each of the first and second surfaces comprises a half-moon configuration.

5. The container cap of claim 1 wherein the junction is configured to restrict fluid passage therethrough.

6. The container cap of claim 1 wherein the protruding stem is disposed proximate the center of the first side of the first surface and is configured with a taper narrowing toward a tip of the stem.

7. A method of capping a container comprising:

connecting a cap to a container, the cap comprising a body having a lower portion with internal threads for connecting to the container, and an upper portion with a walled section defining a main opening;

wherein the upper portion has a first surface defining an opening and a stem protruding upwardly from a first side of the first surface through the main opening, the stem being free from contact with the walled section of the upper portion and unobstructed in a 360 degree radial direction for the length of the stem, the lower portion has a second surface defining an opening, the upper portion and the lower portion rotate with respect to one another such that the openings in the first and second surfaces align between a closed position and an open position to selectively permit fluid flow therethrough;

wherein the upper portion and the lower portion comprise separate pieces coupled together via a junction configured to permit rotation of the pieces with respect to one another;

wherein the second surface comprises a raised portion formed along a circumference of a first side of the second surface, the raised portion configured for complementary engagement with a depression formed on a second side of the first surface opposite the first side of the first surface.

8. The method of claim 7 wherein the cap comprises a detent mechanism to align the openings in the first and second surfaces in a fully open or fully closed position when the upper portion or the lower portion is rotated with respect to the other portion.

9. The method of claim 8 wherein the detent mechanism comprises a protruding pin formed on one of the first or second surface, the pin configured for complementary engagement with a depression formed on the other of the first or second surface.

10. The method of claim 7 wherein the opening on each of the first and second surfaces comprises a half-moon configuration.

11. The method of claim 7 wherein the junction is configured to restrict fluid passage therethrough.

12. The method of claim 7 wherein the protruding stem is disposed proximate the center of the first surface and is configured with a taper narrowing toward a tip of the stem.

13. A container cap comprising:

a cap body having a lower portion with internal threads for connecting to a container, and an upper portion with a walled section defining a main opening;

the upper portion having a first surface defining an opening;

the upper portion having a stem protruding upwardly from a first side of the first surface through the main opening, wherein the stem is free from contact with the walled section of the upper portion and unobstructed in a 360 degree radial direction for the length of the stem;

the lower portion having a second surface defining an opening;

wherein the upper portion and the lower portion rotate with respect to one another such that the openings in the first and second surfaces align between a closed position and an open position to selectively permit fluid flow therethrough, wherein the upper portion and the lower portion comprise separate pieces coupled together via a junction configured to permit rotation of the pieces with respect to one another;

wherein the second surface comprises a raised portion formed along a circumference of a first side of the second surface, the raised portion configured for complementary engagement with a depression formed on a second side of the first surface opposite the first side of the first surface.

14. The container cap of claim 13 further comprising a detent mechanism configured to align the openings in the first and second surfaces in a fully open or fully closed position when the upper portion or the lower portion is rotated with respect to the other portion.

15. The container cap of claim 14 wherein the main opening of the upper portion comprises a telescoping spout.

16. The container cap of claim 14 further comprising a lid configured to cover the main opening of the upper portion.

* * * * *